US007596837B1

(12) United States Patent
Tucker

(10) Patent No.: US 7,596,837 B1
(45) Date of Patent: Oct. 6, 2009

(54) PASSIVE RESTRAINT SYSTEMS FOR HUMAN OCCUPANTS OF VEHICLES

(75) Inventor: Curt L. Tucker, Saginaw, MI (US)

(73) Assignee: C & K Safety, LLC, Midland, MI (US)

( * ) Notice: Subject to any disclaimer, the term of this patent is extended or adjusted under 35 U.S.C. 154(b) by 407 days.

(21) Appl. No.: 11/529,112

(22) Filed: Sep. 28, 2006

(51) Int. Cl.
*A44B 11/25* (2006.01)

(52) U.S. Cl. ..... 24/630; 24/632; 24/633

(58) Field of Classification Search ..... None
See application file for complete search history.

(56) References Cited

U.S. PATENT DOCUMENTS 3,520,034 A * 7/1970 Frisk et al. ..... 24/579.11
3,605,207 A * 9/1971 Glauser et al. ..... 24/632
3,925,853 A * 12/1975 Nicklin ..... 24/312
4,099,306 A * 7/1978 Matthews et al. ..... 24/69 SB
4,644,618 A * 2/1987 Holmberg et al. ..... 24/630
4,742,604 A * 5/1988 Mazelsky ..... 24/579.09
D301,993 S * 7/1989 Daniels ..... D11/208
5,086,548 A * 2/1992 Tanaka et al. ..... 24/632
5,604,964 A * 2/1997 Aoshima ..... 24/632
5,996,192 A * 12/1999 Haines et al. ..... 24/625
6,049,954 A * 4/2000 Britto ..... 24/579.11
6,543,101 B2 * 4/2003 Sack et al. ..... 24/633
2006/0123607 A1 * 6/2006 Howell ..... 24/615

* cited by examiner

*Primary Examiner*—Jack W. Lavinder
(74) *Attorney, Agent, or Firm*—Robert L. McKellar; McKellar IP Law, PLLC

(57) ABSTRACT

A passive restraint system for human occupants in a vehicle including separable belt buckles that are useful in one embodiment as a buckle for the passive restraint system that is commonly used in racing gear, such as automobile racing.

4 Claims, 11 Drawing Sheets

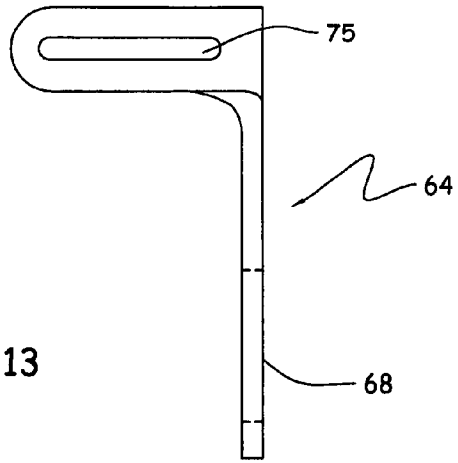
FIG 14
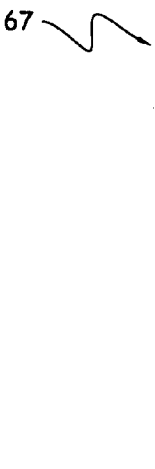
FIG 16
RIGHT
FIG 13
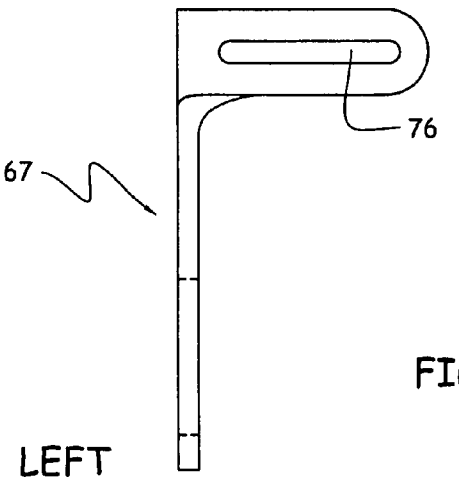
FIG 15
LEFT

PASSIVE RESTRAINT SYSTEMS FOR HUMAN OCCUPANTS OF VEHICLES

BACKGROUND OF THE INVENTION

This invention deals with passive restraint systems for human occupants of vehicles and to separable belt buckles that are useful in one embodiment, as a buckle for a safety harness that is commonly used in racing gear, such as automobile racing, for example.

The buckles are strong, reliable, and have a release mechanism that will allow the user to release all of the belts of the racing harness that are connected thereto, at the same time, and without undue effort. In other words, the buckles are separable by the use of one hand of the user, which is a requirement for safety harnesses used in racing.

Many such devices are described in the prior art and are of interest, namely, U.S. Pat. No. 1,158,827, that issued on Nov. 2, 1915 to Moricet; U.S. Pat. No. 1,303,652, that issued on May 13, 1919 to Girdler; U.S. Pat. No. 1,877,704, that issued on Sep. 13, 1932 to Switlik; U.S. Pat. No. 2,372,558, that issued on Mar. 27, 1945 to Dowd; U.S. Pat. No. 3,860,998 that issued on Jan. 21, 1975 to Schnurmacher; U.S. Pat. No. 4,367,570 that issued on Jan. 11, 1983 to Barbal; U.S. Pat. No. 4,656,700, that issued on Apr. 14, 1987 to Tanaka, et al.; U.S. Pat. No. 5,306,044 that issued Apr. 26, 1994 to Tucker; U.S. Pat. No. 5,832,573, that issued on Nov. 10, 1998 to Howell; U.S. Pat. No. 6,390,562, that issued on May 21, 2002 to Takamizu, et al.; U.S. Pat. No. 6,393,677, that issued on May 28, 2002 to Anscher; U.S. Pat. No. 6,678,925 that issued Jan. 20, 2004 to Howell; U.S. Pat. No. 6,684,466 that issued on Feb. 3, 2004 to Nishida et al.; U.S. Pat. No. 6,796,007 that issued on Sep. 28, 2004 to Anscher, and U.S. Pat. No. 6,813,782, that issued on Nov. 9, 2004 to Kintzi et al.

None of the patents of interest have the novel features of the passive restraint system or separable buckles of the instant invention.

The most pertinent art appears to be U.S. Pat. No. 4,099,306, that issued Jul. 11, 1978 to Matthews, et al. in which there is shown a separable buckle that is adapted to connect two separable belts. There is a first structural member in the form of a floating link that is typically secured permanently to one end of a first belt. A second structural member is adapted to be permanently secured to the end of the other belt.

Permanently attached to the second structural member is a lever that is pivotable about a control axis near the distal end of the second structural member. The control axis is preferably elevated above the plane defined by the remote ends of the two structural members as an aid to keeping the buckle closed. At an intermediate position along the lever there is provided an open-face cusp that is adapted to receive the distal end of the floating link. In latching the buckle, the lever is rotated to an extended position, and the distal end of the floating link is rested against the cusp. By rotating the lever through about 180° to a folded condition alongside the second structural member, the floating link is drawn toward the second structural member. By causing the lever to rotate "over-center", the buckle becomes essentially self-latching. Also disclosed by this reference is means for securing auxiliary straps, such as shoulder straps, or leg straps, to the buckle when it is in a latched condition. A good illustration of how the buckle operates can be found in FIGS. 5A to 5C of that reference.

The buckle of the instant invention differs is several significant ways, for example, the lever has two hooked configurations that allows the lever to grasp the first structural member in two separate places. This allows for more secure buckling as will be detailed infra. Further, the buckle of this invention has a positive latch mechanism. Also, the buckle of the instant invention has a one digit, spring loaded, release mechanism that by-passes the problems associated with having to use two hands to release the buckle, especially when the used has to vacate a vehicle under emergency conditions.

THE INVENTION

The invention deals in one embodiment a separable belt buckle comprising three basic components, a first structural member constituting a link of pre-determined length; a second structural member constituting a base plate and a third structural member constituting a lever.

The first structural member is a flat plate having a horizontal plane, a center point, a distal end and a near end. The flat plate has a first opening near the near end, a second opening near the center point, a third opening adjacent the second opening, and a fourth opening near the distal end, the distal end of the flat plate being angled downwardly at approximately a 35° to 55° angle from the horizontal plane, the most preferred angle being 45°.

The second structural member comprises a flat plate having a distal end, a near end, a horizontal plane and a top surface wherein the horizontal plane is defined by the two ends of the flat plate.

The second structural member has a first opening near the distal end and an elongated second opening beginning at the near end and extending towards the distal end. The second structural member has a first stanchion securely mounted on the top surface near the near end and straddling the elongated second opening. In addition, there is a second stanchion mounted on the top surface and near the distal end.

The first stanchion has holes through it to receive a securing pin. The holes have a securing pin through them.

The second stanchion comprises a retractable lock mechanism, wherein the lock mechanism comprises a housing having a separable end, wherein the separable end has a top end. The separable end also has a fastening hole through it, near the top end. There is a fastening device located in the fastening hole and the fastening device has a distal end. There is a compressible spring surrounding the fastening device and the spring impinges on a moveable wall located within the housing. The moveable wall has a top end and a bottom end, there being mounted near the top end thereof, a first protruding rod, wherein the first protruding rod has a distal end. The distal end is cut on the bias.

The distal end impinges on a non-movable wall securely mounted on the top surface of the second structural member and the non-movable wall has a bottom end. The moveable wall has a second protruding rod mounted near the bottom end, said second protruding rod being longer than the first protruding rod and having a distal end. There is a second moving wall, having a bottom end, mounted on the distal end of the second protruding rod near the bottom end of the second moving wall. The second protruding rod passes through an opening near the bottom end of the non-moveable wall.

The lever comprises a unitary piece and has a distal end, a near end, and a center point, the lever having hooked configuration at the distal end. There is a hole through the lever near the hooked configuration at the distal end. There is a digit pad mounted on the near end of the lever. There is a second hooked configuration near the center point, said first hooked configuration and second hooked configuration being located on the lever at a predetermined distance from each other. The second hooked configuration has an inside surface, said inside surface has a detent configuration, the lever being mounted near the top surface and in the first stanchion by the securing pin such that the lever partially rotates around the pin.

There is a second embodiment that deals with a combination of the separable buckle described just Supra having two ends in combination with a safety harness, the safety harness comprising a first shoulder belt, a second shoulder belt, two lap belts, and an anti-submarine belt, wherein the first shoulder belt, the second shoulder belt and the antisubmarine belt are all secured by the separable buckle at approximately the same location on the separable buckle, and the two lap belts are attached, one at each end of the separable buckle.

BRIEF DESCRIPTION OF THE DRAWINGS

FIG. 13 is a full front view of the terminal connector 64 for the right shoulder belt 62.

FIG. 14 is a full side view of the terminal connector 64 for the right should belt 62 showing the elongated opening 66.

FIG. 15 is a full front view of the terminal connector 67 for the left shoulder belt 63.

FIG. 16 is a full side view of the terminal connector 67 for the left shoulder belt 63 showing the elongated opening 74.

DETAILED DESCRIPTION OF THE INVENTION

This invention deals with a passive restraint system for human occupants of a vehicle and separable belt buckles that are useful in one embodiment, as buckles for a safety harness that is commonly used in racing gear, such as automobile racing.

Figure 9:
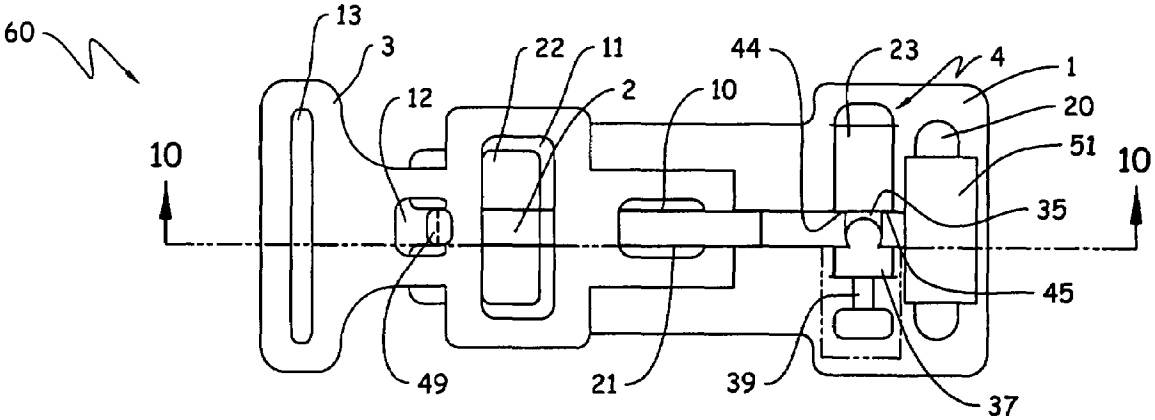
FIG. 9 is a full top view of the complete separable buckle.
Figure 10:
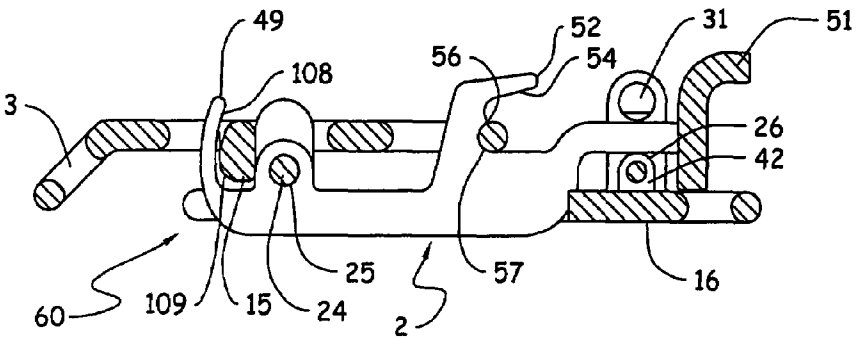
FIG. 10 is a side view of the full separable buckle in cross section through the line A-A showing a full side view of the lever and the locking mechanism.

Turning now to FIGS. 9 and 10, there is shown in FIG. 9 a full top view of a completely assembled separable buckle of this invention without harness straps secured to it, and FIG. 10 is a cross sectional side view of the assembly of FIG. 9, wherein the cross sectional line is taken through line 10-10 of FIG. 9 such that the lever and the release mechanism are fully viewed and are not in cross section.

Figure 1:
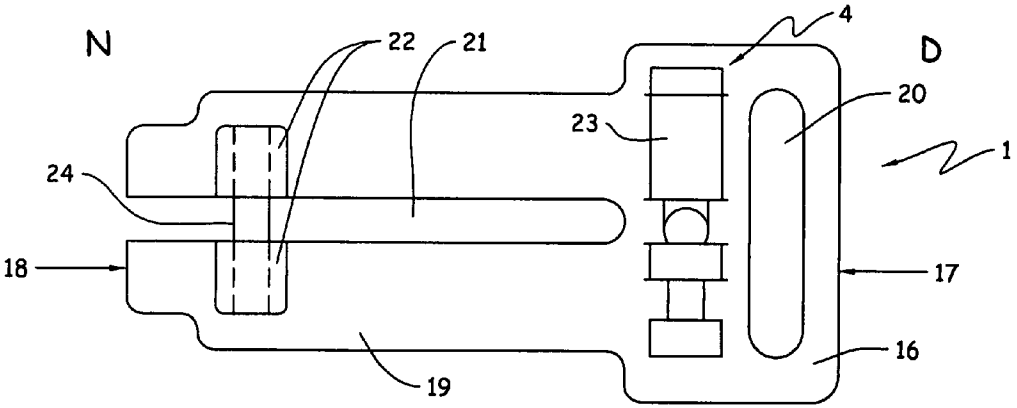
FIG. 1 is a full top view of the base plate (second structural member) of this invention and also showing the release mechanism.
Figure 3:
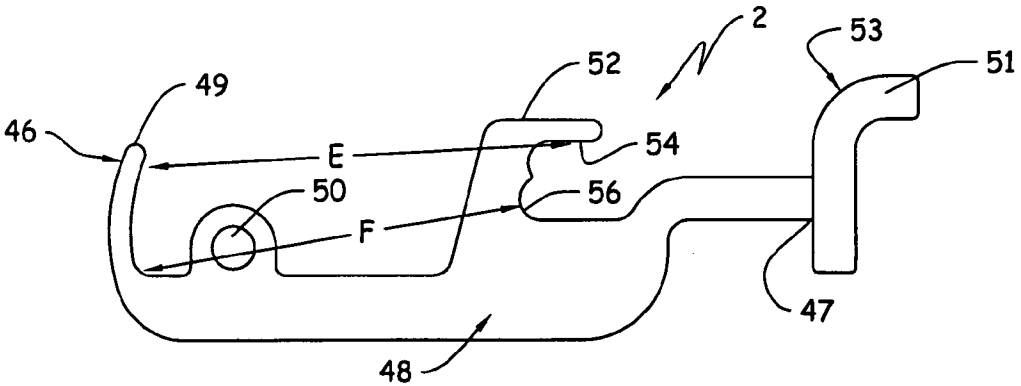
FIG. 3 is a full side view of the lever (third structural member) of this invention.
Figure 5:
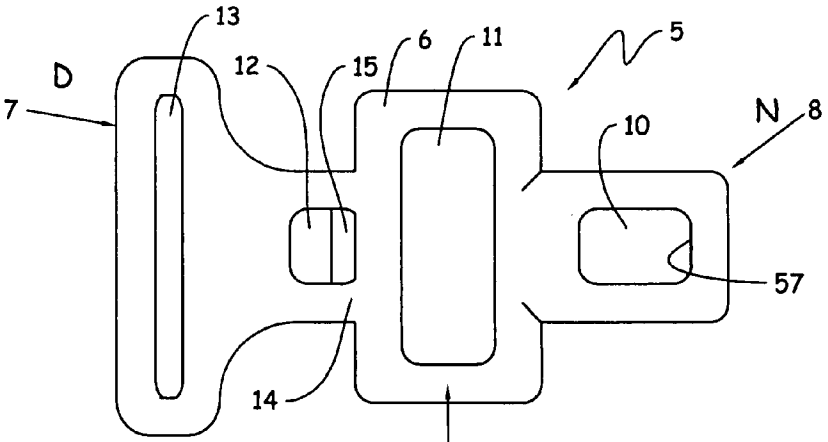
FIG. 5 is a full top view of the link (first structural member) of this invention.

The various components are shown in FIGS. 1, 3, and 5. Thus, there is shown in FIG. 1 a full top view of the base plate 1 of this invention having mounted on the top surface thereof, a release mechanism 4. FIG. 3 show a full side of the lever 2 of this invention and FIG. 5 shows a full top view of the link 3 of this invention.

Figure 6:
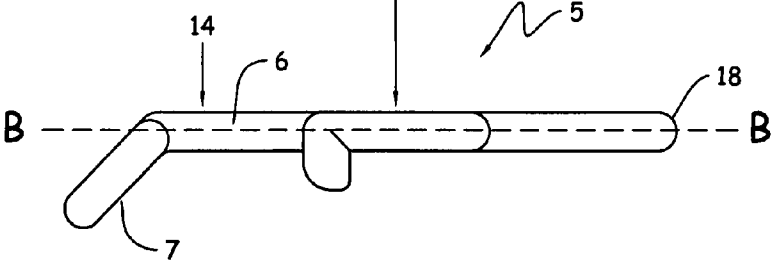
FIG. 6 is a full side view of the link of FIG. 5.

Turning then to FIG. 5, a full top view of the link 3 (first structural member) of this invention, there is shown the flat plate 6 having a distal end 7 and a near end 8 and a horizontal plane defined by the line B-B of FIG. 6. There is a center point or intermediate area 9 in the flat plate 6. There is a first opening 10 near the near end 8 and a second opening 11 near the intermediate area 9. There is a third opening 12 adjacent the opening 11 and a fourth opening 13 near the distal end 7.

The first opening 10 is intended to catch the hooked configuration of the lever (described infra) and the second opening 11 is intended to allow the flat plate 6 to sit down over the stanchion 23 and lay against the top surface 14 of the flat plate 6. Further, the third opening 12 is intended to catch the other hooked configuration 22 of the lever 2 and the fourth opening 13 is an opening that allows for the attachment of a belt, shown in FIG. 11. The opening 12, it will be noted has a front leading wall 15, and it should be further noted that this leading wall 15 is cut on a slight bias. It should also be noted from FIG. 6, that the distal end 7, containing the fourth opening 13 is bent downwardly from the horizontal plane B-B, in a manner that the belts can wrap around the side of the user and maintain pressure against the buckle lever. As indicated Supra, the angle of the end of the buckle is in the range of 35° to 55° from the horizontal plane of the lap belt buckle, and the preferred angle is about 45° (See FIG. 21).

There can be as much as 70 G's of force on the harness of a race driver at certain times during the race. The static load on the buckles of the safety harness is about 11,000 pounds. Excessive stress on the buckle end gives a single release action if the buckle is straight with regard to the horizontal plane. The best situation is for the buckle to realize some amount of stress, to help keep the buckle buckled. The angle on the buckle of the instant invention allows for the load on the buckle to be below the horizontal plane of the buckle, thereby applying some stress to the buckle. Thus, the buckles of the instant invention have the draw point for the buckle below the pivot point of the lever to enhance this action.

The various components are shown in FIGS. 1, 3, and 5. Thus, there is shown in FIG. 1 a full top view of the base plate 1 of this invention having mounted on the top surface thereof a release mechanism 4. FIG. 3 show a full side of the lever 2 of this invention and FIG. 5 shows a full top view of the link 3 of this invention.

Turning then to FIG. 5, a full top view of the link 3 (first structural member) of this invention, there is shown the flat plate 6 having a distal end 7 and a near end 8 and a horizontal plane defined by the line B-B of FIG. 6. There is a center point or intermediate area 9 in the flat plate 6. There is a first opening 10 near the near end 8 and a second opening 11 near the intermediate area 9. There is a third opening 12 adjacent the opening 11 and a fourth opening 13 near the distal end 7.

The first opening 10 is intended to catch the hooked configuration of the lever (described infra) and the second opening 11 is intended to allow the flat plate 6 to sit down over the stanchion 23 and lay against the top surface 19 of the base plate 1. Further, the third opening 12 is intended to catch the other hooked configuration 49 of the lever 2 and the fourth opening 13 is an opening that allows for the attachment of a belt, shown in FIG. 11. The opening 12, it will be noted has a front leading wall 15, and it should be further noted that this leading wall 15 is cut on a slight bias. It should also be noted from FIG. 6, that the distal end 7, containing the fourth opening 13 is bent downwardly from the horizontal plane B-B, in a manner that the belts can wrap around the side of the user and maintain pressure against the buckle lever. As indicated Supra, the angle of the end of the buckle is in the range of 35° to 55° from the horizontal plane of the lap belt buckle, and the preferred angle is about 45° (See FIG. 21).

There can be as much as 70 G's of force on the harness of a race driver at certain times during the race. The static load on the buckles of the safety harness is about 11,000 pounds. Excessive stress on the buckle end gives a single release action if the buckle is straight with regard to the horizontal plane. The best situation is for the buckle to realize some amount of stress, to help keep the buckle buckled. The angle on the buckle of the instant invention allows for the load on the buckle to be below the horizontal plane of the buckle, thereby applying some stress to the buckle. Thus, the buckles of the instant invention have the draw point for the buckle below the pivot point of the lever to enhance this action.

Figure 2:
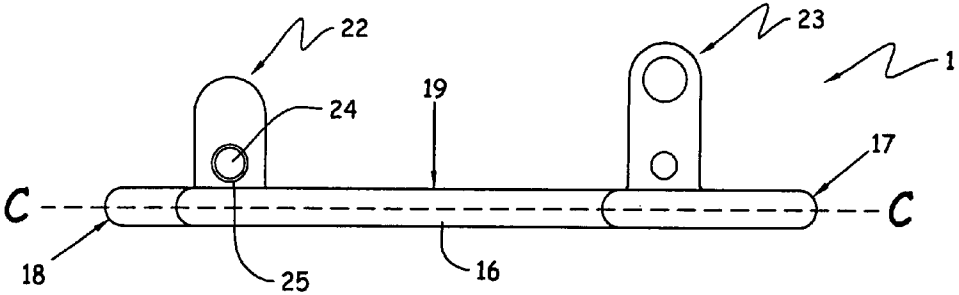
FIG. 2 is a full side view of the base plate of FIG. 1.

Turning now to FIG. 1, that is the base plate 1 (second structural member) of this invention, there is shown the flat plate 16, having a distal end 17, a near end 18, a horizontal plane as defined by the line C-C as shown in FIG. 2, and the top surface 19 of the flat plate 16.

The base plate 1 has a first opening 20 near the distal end 17 and an elongated second opening 21 beginning at the near end and extending towards the distal end 17. The base plate 1 has a first stanchion 22 securely mounted on the top surface 19 near the near end 18 and straddling the elongated second opening 21. It should be noted that the first stanchion 22 has a fastening pin 24 inserted in openings 25 in the stanchion 22, portions of which are shown in phantom in FIG. 1. In addition, there is a second stanchion 23 mounted on the top surface 19 and located near the distal end 17.

Figure 8:
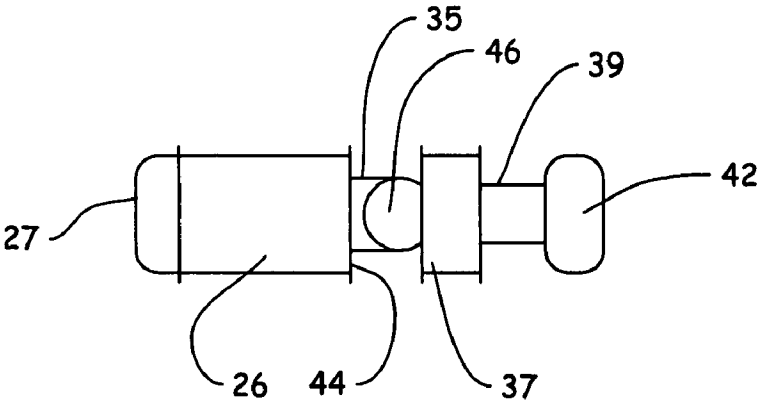
FIG. 8 is a full top view of the release mechanism of FIG. 7.
Figure 7:
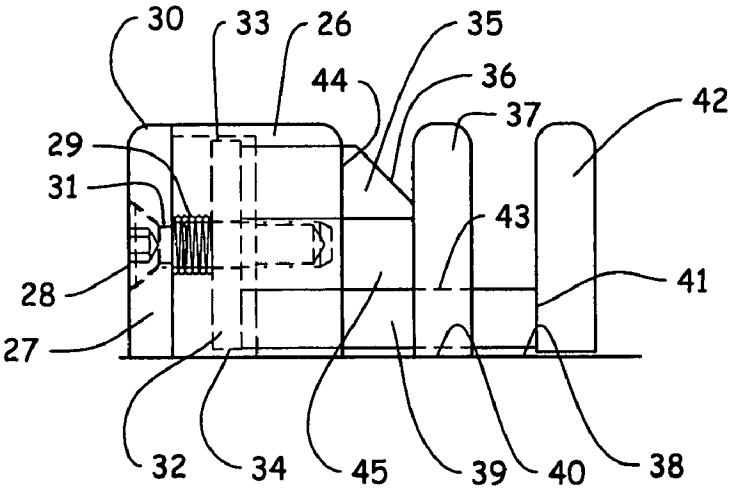
FIG. 7 is a full side view of the release mechanism of this invention.

The second stanchion comprises the retractable lock and release mechanism 4 and can be viewed in FIGS. 7 and 8 and in association with the base plate 1 in FIGS. 1, 2, 9, and 10.

Turning to FIG. 7, there is shown a full side view of the lock and release mechanism 4 of this invention. The lock and release mechanism 4 is a spring loaded shaft and is comprised of a housing 26, having a separable end 27, that is, the separable end 27 can be separated from the housing 26 by the removal of the attachment means 28, in this case shown as a machine screw. This is necessary for the original placement of the spring and in the event that the compressible spring 29 has to be replaced or repaired. The compressible spring 29 as shown surrounds the attachment means 28 and by this means, the compressible spring 29 can be supported and held in the correct position within the housing 26. The separable end 27 has a top end 30 and there is a fastening hole 31 through the separable end 27 near the top end 30 and this fastening hole 31 has positioned within it, a fastening device, i.e. a screw 28. The fastening device 28 has the compressible spring 29 surrounding it. The compressible spring 29 impinges on a moveable wall 32 located within the housing 26. The moveable wall 32 has a top end 33 and a bottom end, 34, there being mounted near the top end 33, and on the opposite side of the moveable wall 32 from the compressible spring 29, a first protruding rod 35. The first protruding rod 35 has a distal end 36 and this distal end 36 is cut on the bias at point 46 (see FIG. 8).

The distal end 36 of the first protruding rod 35 impinges on a non-moveable wall 37 securely mounted on the top surface 38 of the locking mechanism 4. The non-moveable wall 37 has a bottom end 40. The moveable wall 32 has a second protruding rod 39 mounted near the bottom end 40 and on the opposite of the moveable wall 32 from the compressible spring 29, said second protruding rod 39 being longer than the first protruding rod 35, and it has a distal end 41 and is parallel with the first protruding rod 35.

There is a second moving wall 42 having a bottom end 43, that is mounted on the distal end 41 of the second protruding rod 39 near the bottom end 40 of the second moving wall 42. The second protruding rod 39 passes through an opening 43 near the bottom end 40 of the non-moveable wall 37.

When the locking mechanism 4 is at rest, i.e. in the locking position, the moveable wall 42 stands off from the non-moveable wall 37 a short distance, which would be equivalent to the distance between the non-moveable wall 37 and the back wall 44 of the housing 26.

When it is intended to release the lever 2, the moveable wall 42 is depressed towards the non-moveable wall 37, which moves the second protruding rod 39 in the same direction, which moves the first moveable wall 32, which in turn moves the first protruding rod 35 in the same direction, and compresses the spring 29. This allows the user to raise the lever 2 from the resting space 45 created by the back wall 44, the bottom 38 of the locking mechanism 4, and the non-moveable wall 37, thereby releasing the lever 2.

Figure 4:
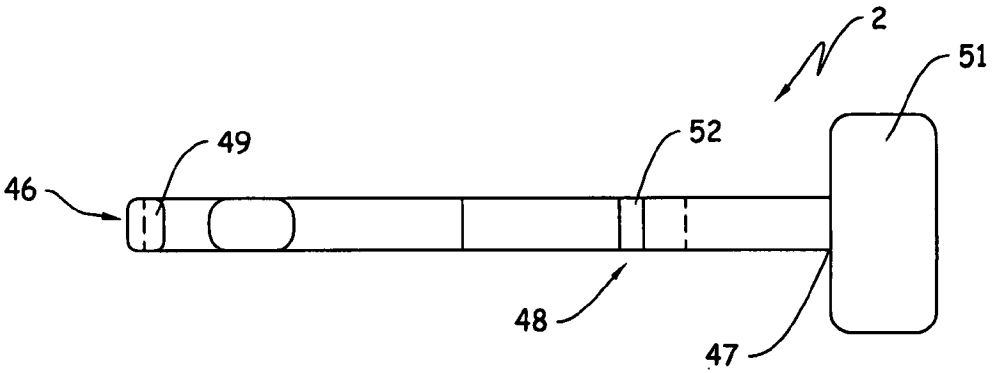
FIG. 4 is a full top view of the lever of FIG. 3.

Turning now to FIGS. 3 and 4 and with regard to FIG. 3, there is shown a full side view of the lever 2 of this invention. The lever 2 comprises a unitary piece and has a distal end 46, a near end 47, and an intermediate area 48. The lever 2 has a first hooked configuration 49 at the distal end 46 and a hole 50 through the lever 2 near the first hooked configuration 49 at the distal end 46. There is a digit pad 51 mounted on the near end 47 of the lever 2. Also, there is a second hooked configuration 52 near the intermediate point 48. The first hooked configuration 49 and the second hooked configuration 52 are located on the lever 2 at a predetermined distance from each other. This distance conforms to the various openings in the link 3, in that, the first hooked configuration 49 enters the opening 12 and the second hooked configuration 52 enters the opening 10 in the link 3 and rests in the respective openings when the separable buckle is fully closed.

There is a digit pad 51 attached to the near end 47 of the lever 2. The digit pad 51 is configured such that there is a slight bend at the top 53 of the digit pad 51, such that when the operator desires to release the lever 2, the second moving wall 32 of the locking mechanism 4 is pushed towards the non-moveable wall 37, moving the first protruding rod 35 out of the way and pressure is exerted on the digit pad 51 in an upward motion to move the lever 2 up and out of the resting space 45, thus releasing the separable buckle and any auxiliary straps attached thereto.

The second hooked configuration 52 has an inside surface 54. The inside surface 54 has a detent in the surface in that the upper surface first encounters the link 3, and as the lever 2 is moved downwardly into its locking, position, the detent 56 receives the wall 57 (FIG. 5) and holds the link 3 securely. By this means, the pressure exerted in locking the locking mechanism 4 and drawing the various belts together is smoother and takes less force to accomplish. It should be noted that the surface 54 is an angled surface such that the as the lever 2 is closed, the link will slide down smoothly into the detent 56.

The lever 2 is mounted near the top surface 14 of the flat plate 6 in the first stanchion 22 by means of holes 58 in the stanchion walls and a fastening pin 59 around which the lever 2 can partially rotate, that is, the lever 2 can rotate about 180°, moving from essentially a position in the elongated opening 21 in the flat surface of the base plate at the back of the base plate 1, to the elongated opening 21 in the flat surface of the front of the base plate 1.

Returning to FIGS. 9 and 10 there is shown in FIG. 9 a fully closed separable buckle of this invention comprising the fourth opening 13, the link 3, the third opening 12, the first stanchion 22, the second opening 11, the lever 2, the first opening 10, the back wall 44 of the housing, the second stanchion 23, the base plate 1, the locking mechanism 4, the resting space 45 for the lever, the opening in the distal end of the base plate 20, the digit pad 51, the first protruding rod 35, the non-moveable wall 37, the second protruding rod 37, the second opening (elongated) 21, and the first hooked configuration 49.

FIG. 10 is a side view of the full separable buckle 60 in cross section through the line A-A of FIG. 9, showing a full side view of the lever and the locking mechanism 4 wherein there is shown the first hooked configuration 49, the pin 24 in the near end of the base plate 1, the opening for the pin 25, the second hooked configuration 52, the upper surface 55 and lower detent 56 in the second hooked configuration 52, the fastening hole 31, the digit pad 51, the housing 26, the second moving wall 42, the flat plate 16 of the base plate 1, the full side view of the lever 2, and the link 3.

Figure 11:
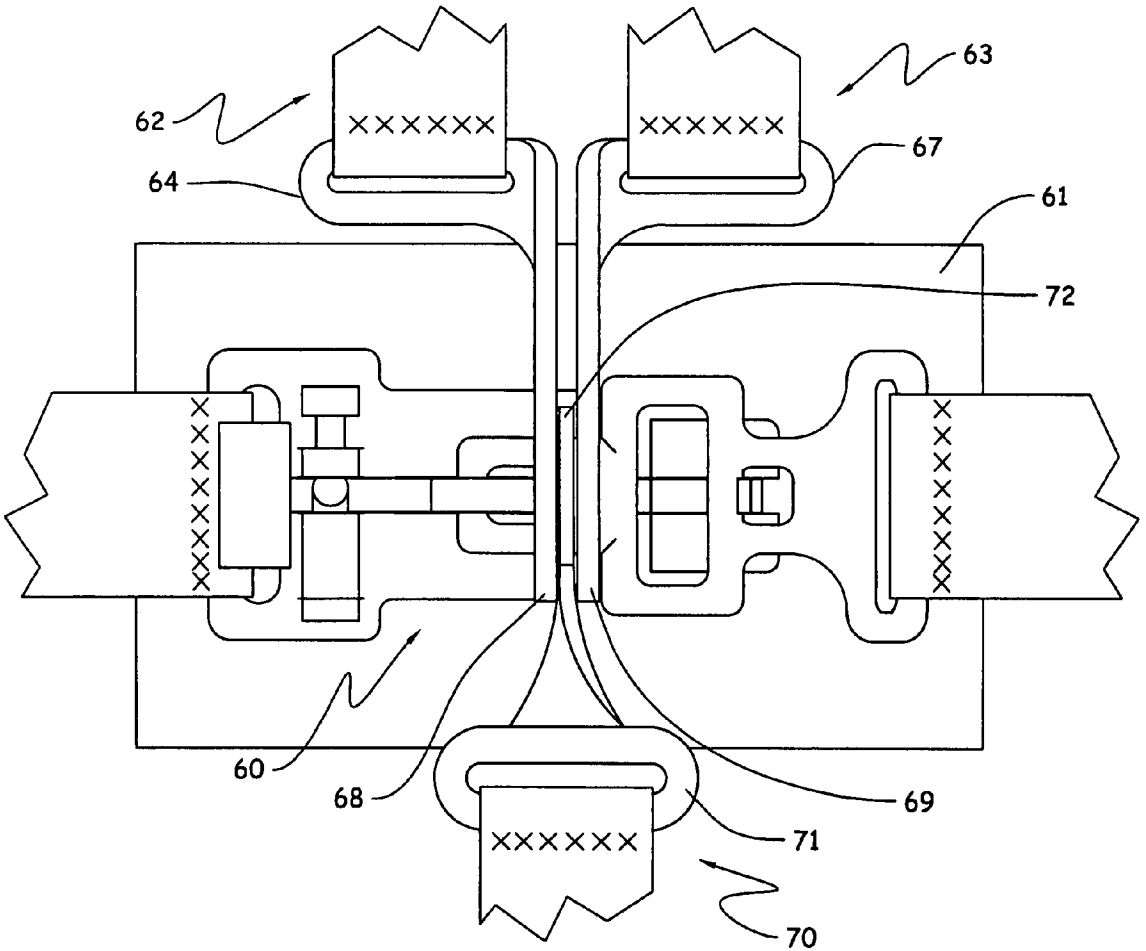
FIG. 11 illustrates the linking of the various belts of a safety harness to the separable buckle wherein the view is towards the front of the user.

FIG. 11 is a full top view of the separable buckle of this invention as it is attached to the various belts that make up the safety harness. Typical safety harnesses comprise, generally, a first shoulder belt, a second shoulder belt, two lap belts, and an antisubmarine belt (crotch belt).

In the safety harness of this invention, and with reference to FIG. 11, there is shown a fully closed separable buckle 60 resting on a lap pad 61.

For purposes of this disclosure, the right shoulder belt 62 is shown on the left side of the FIG. 11 (and in FIGS. 13 and 14) and the left shoulder belt 63 is shown on the right side of the FIG. 11 (and in FIGS. 15 and 16). With regard to the belts attached to the separable buckle 60, the belt for the right shoulder 62 is attached to the terminal connector 64 through belt opening 75 and with regard to the left shoulder belt 63, it is attached to the terminal connector 67 through belt opening 76 and all of the opposite ends of the belts terminate and are securely bolted or welded to the floor of the vehicle or some other anchoring point. Such bolted or welded connections are not shown in FIG. 11, as they are standard in the industry. Each of the shoulder belts 62 and 63 has a terminating connector. For the right shoulder belt 62 there is a terminating connector 64 that is configured such that the terminal end 68, that is, the end opposite of the attachment to belt 62, is twisted such that it will align with and insert over the end of the first opening 10 of the link 3. This attachment is achieved by providing an elongated opening 66 in the terminal end 68 of the connector 64 that allows the terminal end 68 to slip over the first opening 10.

In a like manner, the left shoulder belt 63 has a terminating connector 67 that is configured such that the terminal end 69, that is, the end opposite of the attachment to the belt 63, is twisted in the opposite direction such that it will align with and insert over the first opening 10 of link 3. This attachment is achieved by providing an elongated opening 74 in the terminal end 69 of the terminal connector 67 that allows the terminal end 69 to slip over the first opening 10 on link 3.

Figure 18:
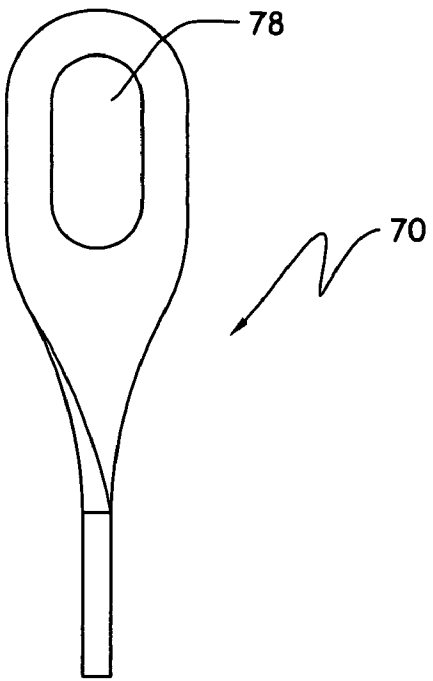
FIG. 18 is a full side view of the terminal connector 70 for the antisubmarine belt 70 showing the elongated opening 78.
Figure 17:
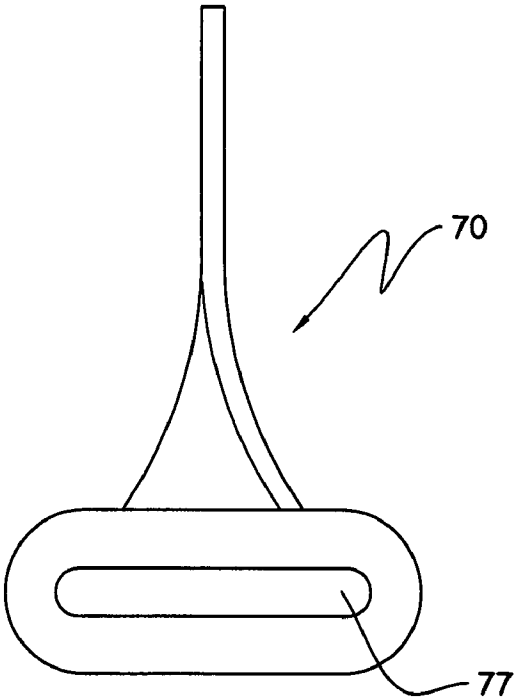
FIG. 17 is a full front view of the terminal connector 70 for the antisubmarine belt 70.

Also with reference to FIG. 11 (and FIGS. 17 and 18) the antisubmarine belt 70 has a terminating connector 71 that is configured such that the terminal end 72 is twisted 190° from the flat plane of the connector 71. This is so the terminal end 72 can align with and compliment the alignment of the shoulder belt connectors on the link 3. This is accomplished by an opening 78 through the terminal connector 70. In addition, antisubmarine belt 70 has the belt attached to it through the belt opening 77.

Thus, as will be observed from FIG. 11, before the separable buckle 60 is totally fastened together, the terminal end 69 of the terminal connector 63 is slipped over the near end 8 of the link 3, then the terminal end 72 of the terminal connector 71 is slipped over the near end 8 of the link 3, and then finally, the terminal end 68 of the terminal connector 64 is slipped over the near end 8 of the link 3, and then the lever 2 is engaged in the opening 10 of the link 3, and then the lever 2 is pressed into the resting space 45 and underneath the first protruding rod 35 where it is securely locked in place, and thereby securely locking in place the two shoulder belts and the antisubmarine belt. The base plate 1, at its distal end 7 has attached thereto the right lap belt 65 and the link 3 has attached at its distal end 7 the left lap belt 73, and thus, all of the belts of the harness are now securely hooked together and anchored to the floor to some other substructure of the vehicle.

In releasing the separable buckle 60, the user merely pushes the second moveable wall 42, which retracts the first protruding rod 35 and releases the lever 2 from the base plate 1, while a finger, usually, the forefinger is used to lift the lever 2 by use of the digit pad 51 whereby, the entire safety harness is detached from the user.

Figure 12:
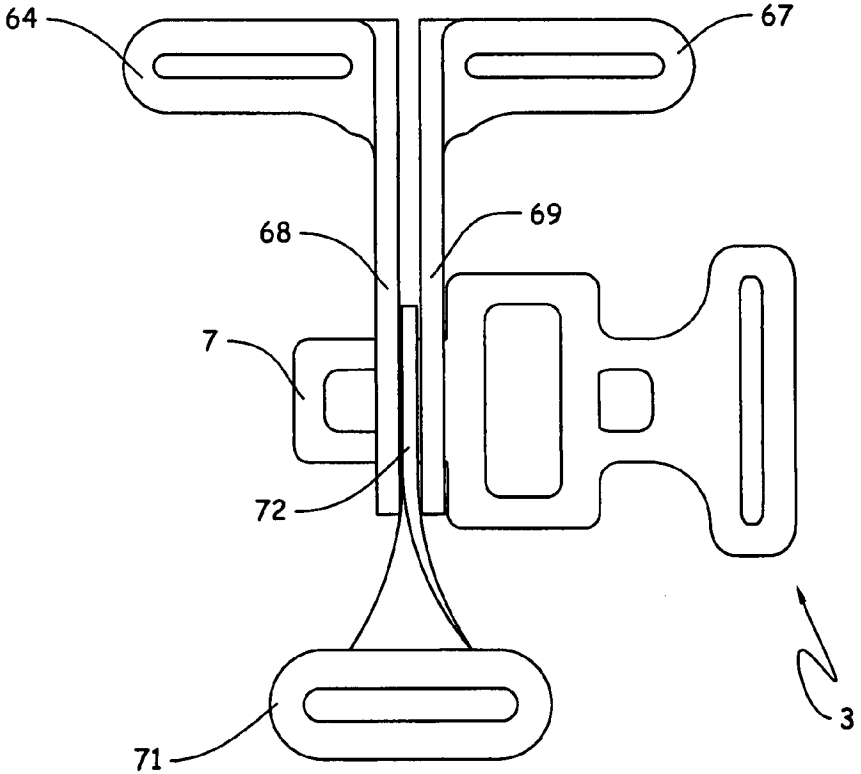
FIG. 12 is an enlarged view of the separable buckle wherein the various harness belts are attached to the buckle.

FIG. 12 is an enlarged view of a portion of the separable buckle 60 showing the connection of the terminal connectors of the various belts. The belts are not shown for clarity. Thus, there is shown the link 3, the distal end 7 of the link 3, the right shoulder belt connector 64, the left shoulder belt connector 67 and the antisubmarine belt connector 71. As can be observed from FIG. 12, the terminal ends 68, 69, and 71 are slipped over the distal end 7 of the link 3 before closing the separable buckle 60. Note that the terminal end 69 is put on first, then terminal end 72, and then terminal end 68.

FIGS. 14 to 18 are shown for the purposes of showing the elongated openings 66, 74, and 78 of each of the terminal connectors 64, 67, and 71.

Reference is made to FIGS. 3 and 10, wherein there is shown in FIG. 3, lines E and F. The distance between the top ends and inside surfaces of the first and second hooks is critical as shown by line E, and the distance between the bottom or detents of the first and second hook are also critical. This distance E is such that when the inside surface 54 touches the inside surface of wall or bar 57 (FIG. 10), then the inside surface 108 must also touch the top inside surface of the leading wall of the opening 12. Also, when the harness is drawn tight around the occupant, the lever 2 drops into the locking stanchion 23, the length of the line indicating the distance F is such that the wall or bar 57 drops into the detent 56 of the second hooked configuration 52 at the same time that the wall or bar 15 drops into the bottom 109 of the first hooked configuration 49. The timing of these two positions is thus critical to using the belt and allowing it to couple together to apply the necessary stress to the buckle to help hold it coupled.

Turning now to the single hook separable belt buckle, it is also comprised of three basic components, namely, a first structural member constituting a link of pre-determined length; a second structural member constituting a base plate, and a third structural member constituting a lever.

The first structural member is a flat plate having a horizontal plane, a distal end and a near end, the flat plate having a first opening near the near end, a second opening near the near the distal end, and the distal end of the flat plate is angled downwardly from the horizontal plane.

The second structural member comprises a flat plate having a distal end, a near end, a horizontal plane and a top surface. The second structural member has a first opening near the distal end and an elongated second opening beginning at the near end and extending towards the distal end, the second structural member having a stanchion securely mounted on the top surface near the distal end.

The stanchion comprises a retractable lock mechanism, the lock mechanism being essentially as that set forth Supra, and the lock mechanism comprises a housing having a separable end. The separable end has a top end and a fastening hole through it near the top end. There is a fastening device located in the fastening hole, wherein the fastening device has a distal end. There is a compressible spring surrounding the fastening device, the spring impinging on a moveable wall located within the housing. The moveable wall has a top end and a bottom end and there is mounted near the top end a first protruding rod. The first protruding rod has a distal end and is cut on the bias at the distal end, the distal end impinging on a non-movable wall securely mounted on the top surface of the second structural member and said non-movable wall having a bottom end.

The moveable wall has a second protruding rod mounted near the bottom end, said second protruding rod being longer than the first protruding rod and having a distal end. There is a second moving wall, having a bottom end, mounted on the distal end of the second protruding rod near the bottom end of the second moving wall. The second protruding rod passes through an opening near the bottom end of the non-moveable wall.

The lever comprises a unitary piece and has essentially identical bifurcated distal ends, a near end, and a center point, the lever having a hooked configuration at the center point. There is a hole through the lever in each of the distal ends and there is a digit pad mounted on the near end of the lever. The hooked configuration has an inside surface and a bottom end, said inside surface having a detent configuration near the bottom end. The lever is mounted near the distal ends by securing pins through the holes in the distal ends such that the lever partially rotates around the pin.

Figure 19:
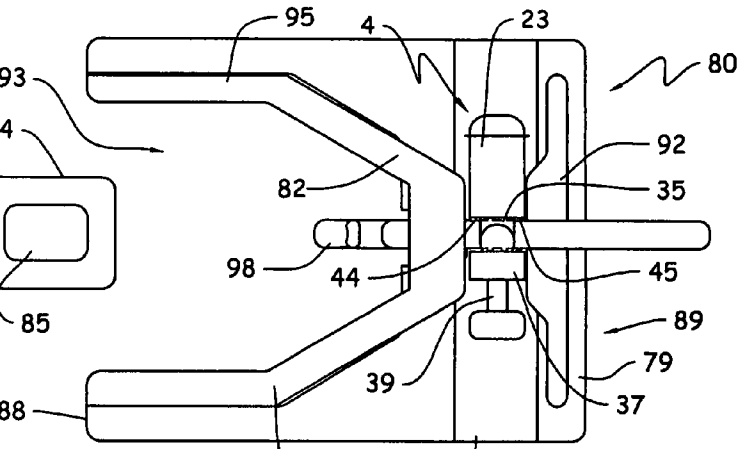
FIG. 19 is a full top view of a single hooked buckle of this invention.
Figure 20:
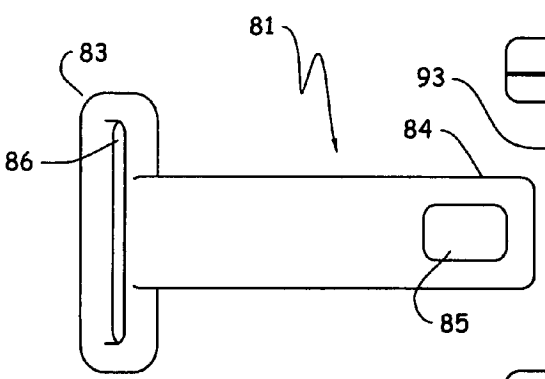
FIG. 20 is a full top view of the link associated with the buckle of FIG. 19.

Turning now to FIG. 19, there is shown a full top view of the single hooked buckle 80 of this invention wherein there is shown the base plate 79, the link 81, and the lever 82.

Figure 21:
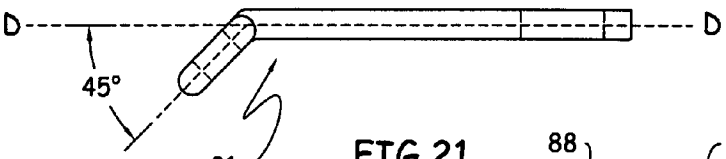
FIG. 21 is a full side view of the link of FIG. 20.

The first structural member, i.e. the link 81 is comprised of a flat plate having a horizontal plane (C-C) as shown in FIG. 21. There is a distal end 83 and a near end 84, and a first opening 85 near the near end 84. There is a second opening 86 near the distal end 83 for fastening one end of a safety belt. It should be noted from FIG. 21, that the distal end 83 of the flat plate is angled downwardly from the horizontal plane C-C. This angle is analogous to the angle for the link 3 of the double hooked separable buckle 60.

Figure 24:
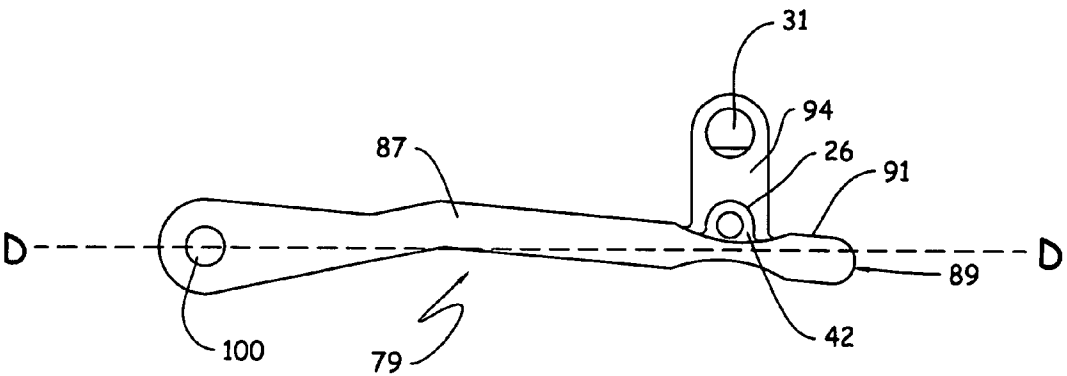
FIG. 24 is a full side view of the base plate of the single buckle.

The second structural member, i.e. the base plate 90 comprises a flat plate 87 having a distal end 88, a near end 89, a horizontal plane line D-D, and a top surface 91. (See also FIGS. 22 and 24).

There is a first opening 92 near the near end 89 and an elongated second opening 93 beginning at the distal end 88 and extending towards the near end 89, the second structural member 79 having a stanchion 94 securely mounted to the top surface 91 of the second structural member 79. There are openings 100 for the insertion of a pin 101, shown in FIG. 22.

The stanchion 94 is identical in most respects to the stanchion described for the double hooked separable buckle 60, Supra, and the details will not be repeated here.

Figure 22:
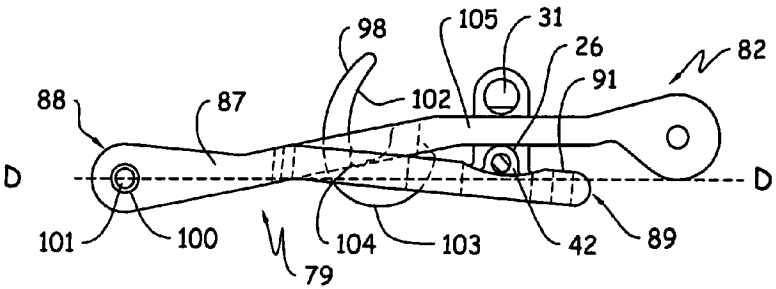
FIG. 22 is a full side view of the lever and base plate in a closed position showing the detent in the hook in phantom.
Figure 23:
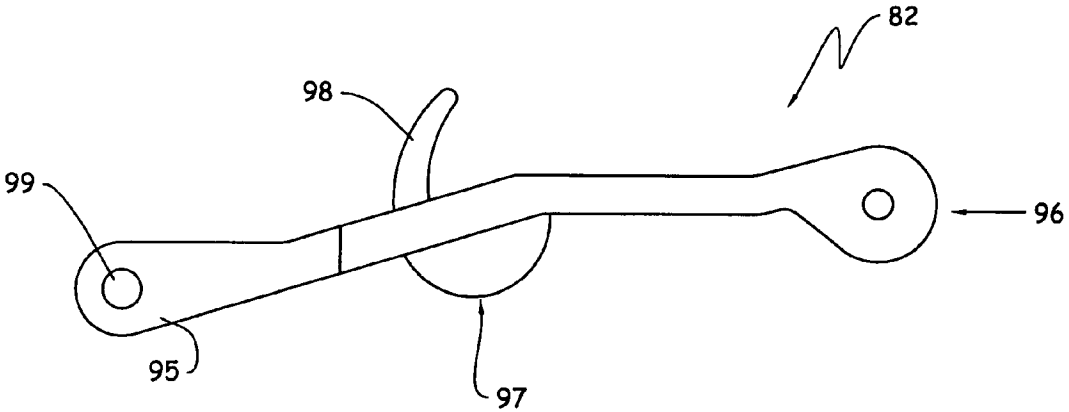
FIG. 23 is a full side view of the lever of the single hooked buckle.

Turning now to FIGS. 19, 22 and 23, there is shown the lever 82. The lever 82 is a unitary piece in construction and has essentially identical bifurcated distal ends 95, a near end 96 and a center point 97. The lever 82 has a hooked configuration 98 at the center point 97 and there is a hole 99 through each of the distal ends 95.

The hooked configuration 98 has an inside surface 102 and a bottom end 103, the inside surface 102 having a detent configuration 100, shown in phantom in FIG. 22, near the bottom end 103. The lever 82 is mounted near the distal ends 95 by securing pins 101 through the holes 99 in the distal ends 95 such that the lever 82 partially rotates around pin 101.

As like the double hooked buckle 60, the single hooked buckle 80 can be used in combination with a safety harness. Thus, the single hooked buckle described just above as a safety harness comprises a first shoulder belt, a second shoulder belt, two lap belts, and an anti-submarine belt, wherein the first shoulder belt, the second shoulder belt and the antisubmarine belt are all secured by the separable buckle at approximately the same location on the separable buckle, and the two lap belts are attached, one at each end of the separable buckle.

What is claimed is:

1. A separable belt buckle comprising three basic components:

a first structural member constituting a link of pre-determined length;

a second structural member constituting a base plate;

a third structural member constituting a lever;

said first structural member being a flat plate having a horizontal plane, a center point, a distal end and a near end, the flat plate having a first opening near the near end, a second opening near the center point, a third opening adjacent the second opening, and a fourth opening near the distal end, the distal end of the flat plate being angled downwardly from the horizontal plane thereof;

said second structural member comprising a flat plate having a distal end, a near end, a horizontal plane and a top surface;

said second structural member having a first opening near the distal end and an elongated second opening beginning at the near end and extending towards the distal end, said second structural member having a first stanchion securely mounted on the top surface near the near end and straddling the elongated second opening, there being a second stanchion mounted on the top surface and near the distal end;

the first stanchion having holes therethrough to receive a securing pin, said holes having retained therein, a pin;

said second stanchion comprising a retractable lock mechanism, said lock mechanism comprising a housing having a separable end, said separable end having a top end, said separable end having a fastening hole therethrough near the top end; there being a fastening device located in the fastening hole, said fastening device having a distal end, there being a compressible spring surrounding the fastening device, said spring impinging on a moveable wall located within the housing, said moveable wall having a top end and a bottom end, there being mounted near the top end thereof, a first protruding rod, said first protruding rod having a distal end and being cut on the bias at the distal end, said distal end impinging on a non-movable wall securely mounted on the top surface of the second structural member and said non-movable wall having a bottom end;

said moveable wall having second protruding rod mounted near the bottom end, said second protruding rod being longer than the first protruding rod and having a distal end, there being a second moving wall, having a bottom end, mounted on the distal end of the second protruding rod near the bottom end of the second moving wall;

said second protruding rod passing through an opening near the bottom end of the non-moveable wall;

the lever comprising a unitary piece and having distal end, a near end, and a center point, the lever having hooked configuration at the distal end, there being a hole through the lever near the hooked configuration at the distal end, there being a digit pad mounted on the near end of the lever, there being a second hooked configuration near the center point, said first hooked configuration and second hooked configuration being located on the lever at a predetermined distance from each other, the second hooked configuration having an inside surface and a bottom end, said inside surface having a detent configuration near the bottom end, the lever being mounted near the top surface and in the first stanchion by the securing pin such that the lever partially rotates around the pin.

2. In combination, the separable buckle of claim 1 having two ends, and a safety harness, said safety harness comprising a first shoulder belt, a second shoulder belt, two lap belts, and an anti-submarine belt, wherein the first shoulder belt, the second shoulder belt and the antisubmarine belt are all secured by the separable buckle at approximately the same location on the separable buckle, and the two lap belts are attached, one at each end of the separable buckle.

3. A separable belt buckle comprising three basic components:

a first structural member constituting a link of pre-determined length;

a second structural member constituting a base plate;

a third structural member constituting a lever;

said first structural member being a flat plate having a horizontal plane, a distal end and a near end, the flat plate having a first opening near the near end, a second opening near the near the distal end, the distal end of the flat plate being angled downwardly from the horizontal plane thereof;

said second structural member comprising a flat plate having a distal end, a near end, a horizontal plane and a top surface;

said second structural member having a first opening near the distal end and an elongated second opening beginning at the near end and extending towards the distal end, said second structural member having a stanchion securely mounted on the top surface near the distal end;

said stanchion comprising a retractable lock mechanism, said lock mechanism comprising a housing having a separable end, said separable end having a top end, said separable end having a fastening hole therethrough near the top end; there being a fastening device located in the fastening hole, said fastening device having a distal end, there being a compressible spring surrounding the fastening device, said spring impinging on a moveable wall located within the housing, said moveable wall having a top end and a bottom end, there being mounted near the top end thereof, a first protruding rod, said first protruding rod having a distal end and being cut on the bias at the distal end, said distal end impinging on a non-movable wall securely mounted on the top surface of the second structural member and said non-movable wall having a bottom end;

said moveable wall having second protruding rod mounted near the bottom end, said second protruding rod being longer than the first protruding rod and having a distal end , there being a second moving wall, having a bottom end, mounted on the distal end of the second protruding rod near the bottom end of the second moving wall;

said second protruding rod passing through an opening near the bottom end of the non-moveable wall;

the lever comprising a unitary piece and having essentially identical bifurcated distal ends, a near end, and a center point, the lever having hooked configuration at the center point there being a hole through the lever in each of the distal ends, there being a digit pad mounted on the near end of the lever, the hooked configuration having an inside surface and a bottom end, said inside surface having a detent configuration near the bottom end, the lever being mounted near the distal ends by securing pins through the holes in the distal ends such that the lever partially rotates around the pin.

4. In combination, the separable buckle of claim 3 having two ends, and a safety harness, said safety harness comprising a first shoulder belt, a second shoulder belt, two lap belts, and an anti-submarine belt, wherein the first shoulder belt, the second shoulder belt and the antisubmarine belt are all secured by the separable buckle at approximately the same location on the separable buckle, and the two lap belts are attached, one at each end of the separable buckle.

* * * * *